US010996003B2

(12) United States Patent
Wei et al.

(10) Patent No.: US 10,996,003 B2
(45) Date of Patent: May 4, 2021

(54) LOOP HEAT PIPE WITH VAPOR-LIQUID TWO-PHASE FLOW INJECTOR

(71) Applicant: Xi'an Jiaotong University, Shaanxi (CN)

(72) Inventors: Jinjia Wei, Shaanxi (CN); Xiaoping Yang, Shaanxi (CN); Lei Liu, Shaanxi (CN); Jie Liu, Shaanxi (CN)

(73) Assignee: Xi'an Jiaotong University, Xi'an (CN)

( * ) Notice: Subject to any disclaimer, the term of this patent is extended or adjusted under 35 U.S.C. 154(b) by 73 days.

(21) Appl. No.: 16/587,025

(22) Filed: Sep. 29, 2019

(65) Prior Publication Data

US 2020/0292244 A1 Sep. 17, 2020

(30) Foreign Application Priority Data

Mar. 12, 2019 (CN) ..... 201910185636.0

(51) Int. Cl.
*F28D 15/00* (2006.01)
*F28D 15/04* (2006.01)

(52) U.S. Cl.
CPC ..... *F28D 15/043* (2013.01)

(58) Field of Classification Search
CPC .. F28D 15/043; F28D 15/046; F28D 15/0266; F28D 15/0233; F28D 15/06; H05K 7/20309; H05K 7/20318; H05K 7/20327; F28F 1/022; F28F 13/06
USPC ..... 165/104.26
See application file for complete search history.

(56) References Cited

U.S. PATENT DOCUMENTS

2005/0077660 A1* 4/2005 Mucciardi ..... F28F 13/06 266/223
2007/0074602 A1* 4/2007 Mucciardi ..... F28D 15/06 75/533

FOREIGN PATENT DOCUMENTS

CN 103200803 A 7/2013

* cited by examiner

*Primary Examiner* — Davis D Hwu

(57) ABSTRACT

A loop heat pipe with a vapor-liquid two-phase flow injector, including: an evaporator, the vapor-liquid two-phase flow injector, a boiling pool and a condenser. The two-phase flow injector has a central vapor inlet and a circumferential liquid inlet, and is connected to an outlet of the evaporator and an inlet of the boiling pool. The condensate inlet of the condenser is connected to an outlet of the boiling pool. An outlet of the condenser is connected to the evaporator. With the vapor-liquid two-phase flow injector, the invention can directly introduce a part of the supercooled liquid working medium to the boiling pool without passing through the evaporator, solving the problem of insufficient liquid supply for the boiling pool and increasing the driving force for the system operation. Therefore, the invention enables the efficient cooling of electronic devices and the long-distance heat transfer.

11 Claims, 2 Drawing Sheets

LOOP HEAT PIPE WITH VAPOR-LIQUID TWO-PHASE FLOW INJECTOR

CROSS-REFERENCE TO RELATED APPLICATIONS

This application claims the benefit of priority from Chinese Patent Application No. 201910185636.0, filed on Mar. 12, 2019. The content of the aforementioned application, including any intervening amendments thereto, is incorporated herein with reference in its entirety.

TECHNICAL FIELD

This application relates to heat dissipation for electronic devices, and particularly to a heat pipe heat-dissipating device, more particularly, a loop heat pipe with a vapor-liquid two-phase flow injector.

BACKGROUND OF THE INVENTION

Electronic devices generate increased heat as they tend to be more integrated, high-power and compact. Therefore, timely and effective heat dissipation will be of great significance for the development of electronic devices. Moreover, traditional methods such as air cooling fail to ensure a sufficiently high heat dissipation rate.

Loop heat pipe is a kind of efficient two-phase heat transfer device, which utilizes the capillary force generated by the capillary wick in the evaporator to drive the loop operation, having significant advantages of large heat transfer coefficient, no moving parts and flexible arrangement. Because of the easy and tight adhesion to the heating surface, small thermal resistance and high efficiency, the flat loop heat pipe has been applied in the heat dissipation of electronic equipments and thermal control of spacecrafts, having broad prospects.

However, there are still some defects in the existing flat loop heat pipes, such as serious back heat-leakage and limited heat-dissipation capacity. Therefore, it is necessary to continuously improve the system structure or develop a new loop heat pipe to improve the heat-dissipation performance. Chinese Patent Application CN103200803A discloses a loop heat pipe with pool boiling, where the evaporator mainly plays a role in utilizing the capillary force generated by the capillary wick to provide a driving force for the operation of the heat pipe and generally employs a small heat load, thereby reducing the back heat-leakage. Moreover, the boiling pool, which is actually in contact with the electronic component, has high heat transfer efficiency.

However, there are still some disadvantages in the loop heat pipe disclosed by the above application. Firstly, the working medium for the boiling pool may be in short supply sometimes, specifically, when the thermal load of the boiling pool is large, the working medium in the pool will evaporate rapidly, so that the working medium supplied by the evaporator is less than that consumed by the boiling pool. Subsequently, the medium in the boiling pool is exhausted and the temperature rises sharply, which causes a large fluctuation in the heat pipe operation temperature and even the start failure, limiting the application of the loop heat pipe in a higher heat flux. In addition, since the capillary force provided by the capillary wick is insufficient to offset the total pressure drop across the loop, the successful operation of the heat pipe also requires the gravity assistance, limiting the use under microgravity and counter gravity conditions.

It can be seen that the above loop heat pipe with pool boiling still needs to be further improved to meet the requirements of practical applications.

The vapor-liquid two-phase flow injector is a special jet pump, in which the high-pressure vapor is expanded via the supersonic vapor nozzle to form a supersonic gas flow. Then the supersonic gas flow is used as a driven source to form a supersonic vapor-liquid two-phase flow after being directly exposed to the low-pressure liquid flow in the mixing chamber with variable sections. When the flow is blocked, the condensation shock may occur, so that an abrupt change is achieved in the pressure to generate a liquid flow with a pressure far exceeding the inlet vapor, thereby greatly boosting the liquid pressure. The vapor-liquid two-phase flow injector substantially converts part of the usable energy of the heat released by vapor condensation into mechanical work to boost the pressure of liquid. According to the position and structure of the vapor nozzle and the liquid nozzle, the supersonic vapor-liquid two-phase flow boosting device can be divided into two basic structural types: a central vapor-circumferential liquid structure, and a central liquid-circumferential vapor structure. The vapor-liquid two-phase flow injector is free of mechanical moving parts and requires no external power, allowing for a high reliability. At present, the vapor-liquid two-phase flow injector has been applied to the heating system, and core emergency water-supply and water-feed systems of the pressurized water reactor and water-supply system of the boiling water reactor in commercial and military ships, but has not been used in the heat dissipation of electronic devices by heat pipe.

SUMMARY OF THE INVENTION

An object of this application is to provide a loop heat pipe with a vapor-liquid two-phase flow injector to solve the problems of insufficient supply of working media in a boiling pool and the insufficient driving force in the existing loop heat pipes. In this application, part of the low-temperature liquid working medium at the outlets of the condenser is directly introduced to the boiling pool without passing through the evaporator, which improves the liquid supply for the boiling pool and boosts the pressure of the working medium, enabling the effective heat dissipation of electronic devices under high heat flux.

The invention adopts the following technical solutions to achieve the above object.

The invention provides a loop heat pipe with a vapor-liquid two-phase flow injector, comprising:

an evaporator;

the vapor-liquid two-phase flow injector;

a boiling pool; and a condenser.

The vapor-liquid two-phase flow injector has a central vapor inlet and a circumferential liquid inlet, and is connected to an outlet of the evaporator and an inlet of the boiling pool. A condensate inlet of the condenser is connected to an outlet of the boiling pool, and an outlet is connected to the evaporator.

In some embodiments, the vapor-liquid two-phase flow injector comprises a vapor nozzle, a liquid nozzle, a mixing chamber, a throat and a diffuser, where the mixing chamber, the throat and the diffuser are sequentially communicated;

the vapor nozzle and the liquid nozzle both communicate with the mixing chamber; the liquid nozzle is provided at an outer side of the vapor nozzle;

the outlet of the evaporator is connected to the vapor nozzle of the vapor-liquid two-phase flow injector through a pipeline at a first vapor zone; and the diffuser of the vapor-liquid two-phase flow injector is connected to the inlet of the boiling pool through a first liquid zone.

In some embodiments, the vapor nozzle is a Laval nozzle.

In some embodiments, the mixing chamber is a tapered channel; the throat is a cylindrical channel; and the diffuser is a flare channel.

In some embodiments, a branch of the outlet of the condenser is connected to the liquid nozzle of the vapor-liquid two-phase flow injector through a third liquid zone.

In some embodiments, the vapor-liquid two-phase flow injector is manufactured by 3D printing.

In some embodiments, the evaporator is square column-shaped or cylindrical.

In some embodiments, the evaporator comprises a compensation chamber, a capillary wick and a vapor groove channel, where the capillary wick is capable of providing a driving force and is provided below the compensation chamber; the vapor groove channel is provided below the capillary wick; and a vapor collection chamber is provided on one side of the vapor groove channel and communicates with the vapor nozzle of the vapor-liquid two-phase flow injector through the first vapor zone.

In some embodiments, a metal foam is provided on a bottom plate of the boiling pool, and a plurality of square-column microstructures are arranged on the metal foam.

In some embodiments, the condenser is provided with a cooling liquid outlet and a cooling liquid inlet.

Compared to the prior art, the invention has the following beneficial effects.

The loop heat pipe with a vapor-liquid two-phase flow injector provided herein includes an evaporator, a vapor-liquid two-phase flow injector, a boiling pool and a condenser. The vapor-liquid two-phase flow injector is introduced between the evaporator and the boiling pool. Since the performance of the central vapor-circumferential liquid structure is better in the case of a higher vapor pressure and a lower liquid pressure, in combination with the characteristics of pressure distribution in loop heat pipes, the invention employs a vapor-liquid two-phase flow injector with a structure of central vapor- and circumferential liquid.

In view of the introduction of the vapor-liquid two-phase flow injector, the invention increases the driving force for the heat pipe operation, making it capable of operating under microgravity and counter gravity conditions. Theoretically, the pressure of the high-pressure liquid at the outlet of the vapor-liquid two-phase flow injector can reach about 26 times that of the vapor at the inlet. Therefore, the increased pressure of the vapor-liquid two-phase flow injector and the capillary force generated by the capillary wick act together as a power source to offset the total pressure drop of the entire loop, reducing the impact of gravity on the loop heat pipe and achieving the long-distance heat transfer.

The invention further simplifies the cooling system of the heat pipe. In the original heat pipe, there are two condensers since the vapor from the evaporator needs to be cooled through a first condenser into liquid which then flows into the boiling pool. However, in the invention, the vapor from the evaporator and the supercooled liquid are mixed in the mixing chamber of the vapor-liquid two-phase flow injector to generate a shock wave, which makes the vapor almost completely condense, and the obtained single-phase liquid directly flows into the boiling pool. Therefore, only one condenser is required in the heat pipe.

With the introduction of the vapor-liquid two-phase flow injector, the invention can directly introduce a part of the supercooled liquid working medium to the boiling pool without passing through the evaporator, thereby solving the problem of insufficient liquid supply for the boiling pool and increasing the driving force for the system operation. Therefore, this invention enables the efficient cooling of electronic devices and the long-distance heat transfer.

In some embodiments, the vapor generated by the evaporator flows into the vapor nozzle and then undergoes an approximate isentropic expansion process to convert part of the thermal energy into kinetic energy, so that the speed is increased to supersonic speed and the pressure is reduced to form a low-pressure zone at the outlet of the vapor nozzle, allowing the supercooled liquid at the outlet of the condenser to smoothly enter the mixing chamber through the liquid nozzle. The supercooled liquid is accelerated by the liquid nozzle to evenly distribute around the supersonic vapor flow in the mixing chamber, enhancing the mixing of the liquid with the vapor. The supersonic vapor flow and the high-speed supercooled liquid mix at the mixing chamber, and since the vapor-liquid two-phase flow is at supersonic speed, a condensation shock wave is finally generated at or downstream the outlet of the mixing chamber (i.e., the throat). After the shock wave, the vapor is almost condensed, increasing the liquid pressure at the outlet of the mixing chamber rapidly. Moreover, when the single-phase liquid working medium flows through the diffuser, part of the kinetic energy is converted into potential energy, so that the speed is reduced to a subsonic speed and the pressure is boosted. Subsequently, the single-phase high-pressure liquid obtained from the diffuser flows into the boiling pool for phase-change heat transfer.

In some embodiments, the outlet of the condenser is connected to the liquid nozzle of the vapor-liquid two-phase flow injector to improve the supply of the working medium to the boiling pool. Besides, the vapor generated by the evaporator, a supercooled liquid ejected from the outlet of the condenser is also introduced to avoid the drying of the boiling pool and improve the thermal load that the heat pipe can bear.

Figure 1:
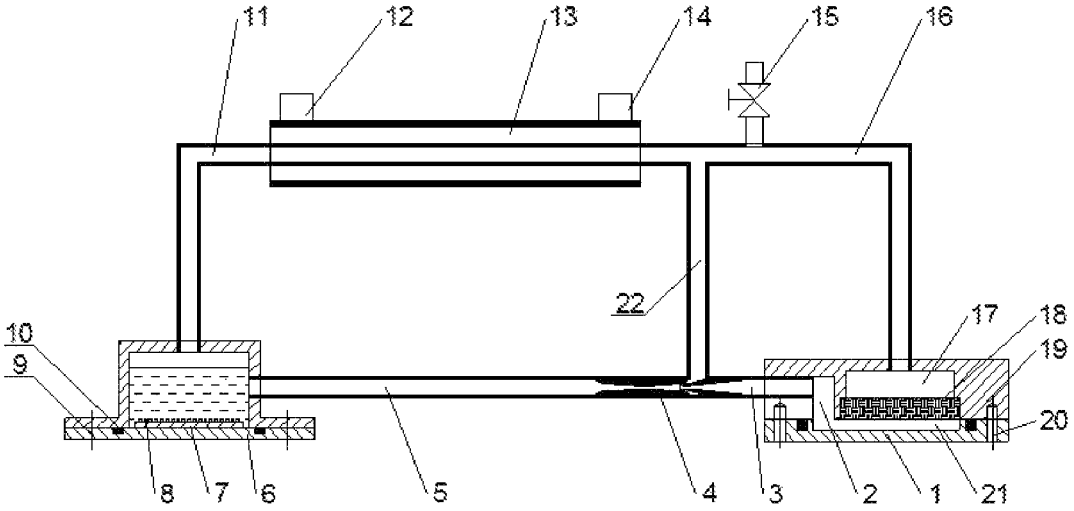
FIG. 1 is a sectional view showing a main body of a loop heat pipe according to an embodiment of the invention.

In the drawings: 1, evaporator; 2, vapor collection chamber; 3, first vapor zone; 4, vapor-liquid two-phase flow injector; 4-1, vapor nozzle; 4-2, mixing chamber; 4-3, throat; 4-4, diffuser; 4-5, liquid nozzle; 5, first liquid zone; 6, boiling pool; 7, metal foam; 8, square-column microstructure; 9, first bolt; 10, first O-ring; 11, second vapor zone; 12, outlet of the cooling liquid; 13, condenser; 14, inlet of the cooling liquid; 15, valve; 16, second liquid zone; 17, compensation chamber; 18, capillary wick; 19, second O-ring; 20, second bolt; 21, vapor groove channel; 22, third liquid zone.

DETAILED DESCRIPTION OF EMBODIMENTS

The invention will be further described with reference to the drawings.

As shown in FIG. 1, a loop heat pipe with a vapor-liquid two-phase flow injector of the invention includes an evaporator 1, the vapor-liquid two-phase flow injector 4, a boiling pool 6 and a condenser 13.

Figure 2:
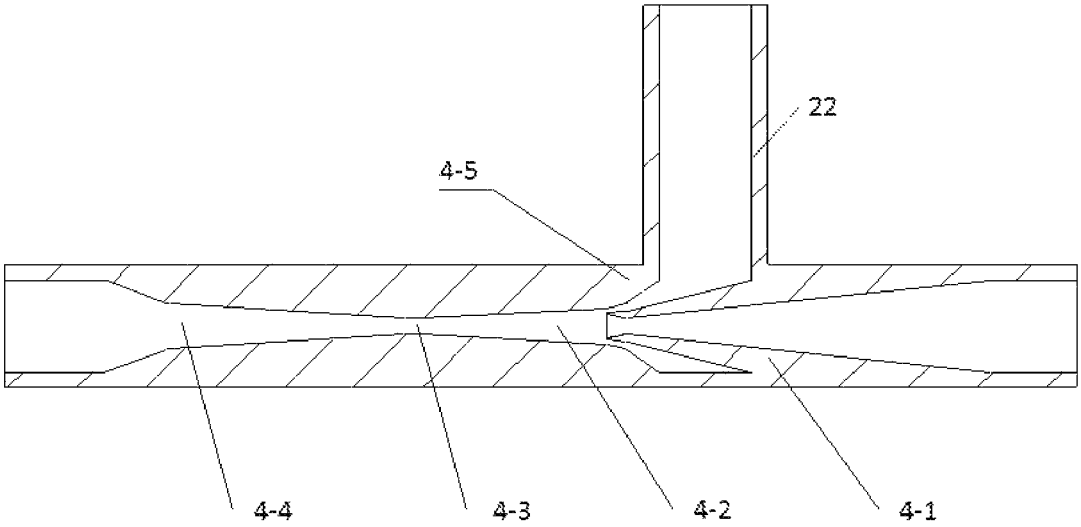
FIG. 2 is a sectional view showing a vapor-liquid two-phase flow injector according to an embodiment of the invention.

As shown in FIG. 2, the vapor-liquid two-phase flow injector 4 includes a vapor nozzle 4-1, a liquid nozzle 4-5, a mixing chamber 4-2, a throat 4-3 and a diffuser 4-4. One end of the vapor nozzle 4-1 extends into the inside of the liquid nozzle 4-5. An inlet of the mixing chamber 4-2 communicates with both the vapor nozzle 4-1 and the liquid nozzle 4-5. The liquid nozzle 4-5 connected to an outlet of the condenser 13 is provided at an outer side of the vapor nozzle 4-1. The throat 4-3 and the diffuser 4-4 communicating with each other are sequentially arranged at an outlet of the mixing chamber 4-2. The vapor nozzle 4-1 is a tapered channel, and particularly a Laval nozzle in the invention. The liquid nozzle 4-5 is an annular gap formed by the outlet of the vapor nozzle 4-1 and the inlet of the mixing chamber 4-2. The mixing chamber 4-2 is a tapered channel, while the diffuser 4-4 is a flare channel. The throat 4-3 is a straight cylindrical channel provided between the mixing chamber 4-2 and the diffuser 4-4. To adapt to the narrow space in the electronic devices for heat dissipation, the size of the vapor-liquid two-phase flow injector is limited, and the outer diameter should be approximately equal to that of the connecting pipes between respective parts of the loop heat pipe. Due to the small size, it is difficult to produce the device of the invention by a method where the respective components are first mechanically manufactured and then assembled. Therefore, the vapor-liquid two-phase flow injector of the invention is integratedly formed by 3D printing.

As shown in FIG. 1, the evaporator 1 is square column-shaped or cylindrical. For the convenience in assembly and disassembly, the upper and lower wall surfaces of the evaporator 1 are connected by a second bolt 20 and sealed by a second O-ring 19. The evaporator 1 includes a compensation chamber 17, a capillary wick 18 and a vapor groove channel 21. The capillary wick 18 is provided below the compensation chamber 17 for providing a driving force. The vapor groove channel 21 is provided below the capillary wick 18. A vapor collection chamber 2 is provided on one side of the vapor groove channel 21 and communicates with the vapor groove channel 21. In addition, the vapor collection chamber 2 is connected to the vapor nozzle 4-1 of the vapor-liquid two-phase flow injector through a first vapor zone 3. A boiling pool 6 is formed by connecting the upper and lower parts using a plurality of first bolts 9 and is sealed by a first O-ring 10, where the pool boiling occurs in a small square column-shaped or cylindrical cavity of the boiling pool 6. A metal foam 7 is provided on a bottom plate of the boiling pool 6, and a plurality of square-column microstructures 8 are arranged on the metal foam 7.

The condenser 13 is provided with a cooling liquid outlet 12 and a cooling liquid inlet 14.

As shown in FIG. 1, the outlet of the evaporator 1 is connected to the vapor nozzle 4-1 of the vapor-liquid two-phase flow injector through a pipeline of the first vapor zone 3. The diffuser 4-4 of the vapor-liquid two-phase flow injector is connected to an inlet of the boiling pool 6 through a first liquid zone 5. An outlet of the boiling pool 6 is connected to an inlet of the double-pipe condenser 13 through a second vapor zone 11. There are two branches provided at the outlet of the condenser 13, where one is connected to the compensation chamber 17 of the evaporator 1 through a second liquid zone 16 which is provided with a valve 15, and the other is connected to the liquid nozzle 4-5 of the vapor-liquid two-phase flow injector through a third liquid zone 22.

The operation principles of the invention are described as follows. A wall surface of the evaporator 1 adheres to a heating surface of an additional heat source. The heat is conducted to the capillary wick 18 through the outer metal wall of the evaporator 1, so that the liquid is vaporized on the surface of the capillary wick 18. Simultaneously, a meniscus is generated at the gas-liquid interface to form a capillary force, so that the generated vapor flows into the first vapor zone 3 through the vapor groove channel 21 and the vapor collection chamber 2. Through the vapor nozzle 4-1, the vapor is accelerated to a supersonic speed, and subsequently, a low-pressure zone is formed at the outlet of the vapor nozzle 4-1, allowing the circumferential supercooled liquid to smoothly enter the mixing chamber 4-2. The supersonic vapor flow and the supercooled liquid are directly contacted and condensed in the mixing chamber 4-2 and gradually mixed evenly to form a condensation shock at the throat 4-3 or a position slightly of the back. Then the vapor is condensed to release energy, eventually forming a high-pressure single-phase fluid. When the single-phase fluid flows through the diffuser 4-4, part of the kinetic energy is converted into potential energy, so that the speed is reduced and the pressure is boosted. Subsequently, the liquid flows into the boiling pool 6 through the first liquid zone 5.

The bottom surface of the boiling pool 6 is bonded to the heating surface of the electronic component, and the heat is transferred to the surface of the square-column microstructure 8 through the bottom plate and the metal foam 7. The liquid working medium entering the boiling pool 6 is evaporated by heat to form a nucleate boiling, and the generated vapor flows into the condenser 13 through the second vapor zone 11 to release heat. The liquid cooled in the condenser 13 is divided into two branches, where one flows back into the compensation chamber 17 via the second liquid zone 16, and the other flows into the liquid nozzle 4-5 via the third liquid zone 22.

A closed cycle of evaporation, condensation, re-evaporation and re-condensation is formed herein, where the first evaporation-condensation process utilizes the capillary force generated by the capillary wick and the pressure-boosting performance of the vapor-liquid two-phase flow injector to provide a driving force for the system, while the re-evaporation-re-condensation process utilizes the efficient heat dissipation of the boiling in the square-column microstructure pool to enable the efficient heat dissipation of electronic devices.

Before the system is operated, the device is required to be vacuumized through the liquid-filling valve 15 to generate negative pressure inside the device, which makes it convenient for the injection of working medium and reduces the boiling point of the working medium, so that the system can be operated at a lower temperature.

Liquid is commonly used in the prior art as the working medium for the gas-liquid two-phase flow injector, however, liquid is replaced herein with methanol or 3M fluorinated liquid FC-72 to reduce the operating temperature of the heat pipe.

The vapor generated by the evaporator flows into the vapor nozzle of the vapor-liquid two-phase flow injector through the first vapor zone, so that a low-pressure zone is formed at the outlet of the vapor nozzle, which attracts part of the supercooled liquid working medium at the outlet of the condenser to enter the mixing chamber through the liquid nozzle for mixing and generates a condensation shock wave, so that the high-pressure single-phase fluid enters the boiling pool for phase-change heat transfer.

What is claimed is:

1. A loop heat pipe with a vapor-liquid two-phase flow injector, comprising:

an evaporator;

the vapor-liquid two-phase flow injector;

a boiling pool; and a condenser;

wherein the vapor-liquid two-phase flow injector has a central vapor inlet and a circumferential liquid inlet and is connected to an outlet of the evaporator and an inlet of the boiling pool;

a condensate inlet of the condenser is connected to an outlet of the boiling pool; and an outlet of the condenser is connected to the evaporator.

2. The loop heat pipe of claim 1, wherein the vapor-liquid two-phase flow injector comprises:

a vapor nozzle, a liquid nozzle, a mixing chamber, a throat and a diffuser;

wherein the mixing chamber, the throat and the diffuser are sequentially communicated;

the vapor nozzle and the liquid nozzle both communicate with the mixing chamber; the liquid nozzle is provided at an outer side of the vapor nozzle;

the outlet of the evaporator is connected to the vapor nozzle of the vapor-liquid two-phase flow injector through a pipeline at a first vapor zone;

the diffuser of the vapor-liquid two-phase flow injector is connected to the inlet of the boiling pool through a first liquid zone.

3. The loop heat pipe of claim 2, wherein the vapor nozzle is a Laval nozzle.

4. The loop heat pipe of claim 2, wherein the mixing chamber is a tapered channel; the throat is a cylindrical channel; and the diffuser is a flare channel.

5. The loop heat pipe of claim 2, wherein a branch of the outlet of the condenser is connected to the liquid nozzle of the vapor-liquid two-phase flow injector through a third liquid zone.

6. The loop heat pipe of claim 1, wherein the vapor-liquid two-phase flow injector is manufactured by 3D printing.

7. The loop heat pipe of claim 1, wherein the evaporator is square column-shaped or cylindrical.

8. The loop heat pipe of claim 1, wherein the evaporator comprises:

a compensation chamber, a capillary wick and a vapor groove channel;

wherein the capillary wick is capable of providing a driving force and is provided below the compensation chamber;

the vapor groove channel is provided below the capillary wick;

a vapor collection chamber is provided on one side of the vapor groove channel and communicates with the vapor nozzle of the vapor-liquid two-phase flow injector through the first vapor zone.

9. The loop heat pipe of claim 7, wherein the evaporator comprises:

a compensation chamber, a capillary wick and a vapor groove channel;

wherein the capillary wick is capable of providing a driving force and is provided below the compensation chamber;

the vapor groove channel is provided below the capillary wick;

a vapor collection chamber is provided on one side of the vapor groove channel and communicates with the vapor nozzle of the vapor-liquid two-phase flow injector through the first vapor zone.

10. The loop heat pipe of claim 1, wherein a metal foam is provided on a bottom plate of the boiling pool, and a plurality of square-column microstructures are arranged on the metal foam.

11. The loop heat pipe of claim 1, wherein the condenser is provided with a cooling liquid outlet and a cooling liquid inlet.

* * * * *